US009489933B2

(12) United States Patent
Itoh

(10) Patent No.: US 9,489,933 B2
(45) Date of Patent: Nov. 8, 2016

(54) RESONANCE TONE GENERATING APPARATUS, METHOD OF GENERATING RESONANCE TONES, RECORDING MEDIUM AND ELECTRONIC INSTRUMENT

(71) Applicant: CASIO COMPUTER CO., LTD., Shibuya-ku, Tokyo (JP)

(72) Inventor: Naoaki Itoh, Tokorozawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/047,986

(22) Filed: Feb. 19, 2016

(65) Prior Publication Data

US 2016/0284329 A1 Sep. 29, 2016

(30) Foreign Application Priority Data

Mar. 23, 2015 (JP) ..... 2015-060154

(51) Int. Cl.
*G10H 1/06* (2006.01)
*G10H 1/14* (2006.01)

(52) U.S. Cl.
CPC ..... *G10H 1/06* (2013.01); *G10H 1/14* (2013.01); *G10H 2210/265* (2013.01); *G10H 2210/271* (2013.01); *G10H 2240/145* (2013.01)

(58) Field of Classification Search
CPC ..... G10H 1/06; G10H 2210/265; G10H 2210/271
USPC ..... 84/622, 626, 659, 662
See application file for complete search history.

(56) References Cited

U.S. PATENT DOCUMENTS 5,157,215 A * 10/1992 Nakae ..... G10H 1/125 704/E11.003
5,157,623 A * 10/1992 Hayashi ..... G06F 17/17 708/313
5,202,528 A * 4/1993 Iwaooji ..... G10H 1/12 84/616
6,180,866 B1 * 1/2001 Kitamura ..... G10H 1/0091 84/630
7,476,797 B2 * 1/2009 Izumisawa ..... G10H 1/0091 84/615
7,642,445 B2 * 1/2010 Izumisawa ..... G10H 1/0575 84/622
7,767,899 B2 * 8/2010 Fujita ..... G10H 1/0091 84/622
7,947,891 B2 * 5/2011 Nakae ..... G10H 1/125 381/63

(Continued)

FOREIGN PATENT DOCUMENTS

JP 2009175677 A 8/2009

*Primary Examiner* — David Warren
(74) *Attorney, Agent, or Firm* — Holtz, Holtz & Volek PC

(57) ABSTRACT

A resonance strength table is prepared, which stores a relation between a pitch difference and a resonance strength, wherein the pitch difference is a difference between a pitch assigned to the key number of a pressed key and a pitch assigned to each of key numbers of a resonance tone. When a key is pressed, the resonance strength table is referred to, and resonance strengths concerning the key numbers of a resonance tone are determined. Then, note-on events of a resonance tone are produced based on the key numbers and the decided resonance strengths and the produced note-on events are sent to a sound source.

18 Claims, 9 Drawing Sheets

(56) References Cited

U.S. PATENT DOCUMENTS 8,178,772 B2 * 5/2012 Iwase ..... G10H 1/0091 84/627
8,754,316 B2 * 6/2014 Shimizu ..... G10H 5/007 84/626
9,245,506 B2 * 1/2016 Nakata ..... G10H 1/06
2007/0175318 A1 * 8/2007 Izumisawa ..... G10H 1/0091 84/626
2009/0000462 A1 * 1/2009 Fujita ..... G10H 1/0091 84/604
2009/0031886 A1 * 2/2009 Iwase ..... G10H 1/0091 84/661
2009/0266219 A1 * 10/2009 Nakae ..... G10H 1/125 84/229
2012/0247306 A1 * 10/2012 Shimizu ..... G10H 5/007 84/616
2013/0061734 A1 * 3/2013 Koseki ..... G10H 1/0091 84/189
2013/0092007 A1 * 4/2013 Ohnishi ..... G10C 3/06 84/192
2015/0221296 A1 * 8/2015 Nakata ..... G10H 1/06 84/725
2015/0228261 A1 * 8/2015 Nakata ..... G10H 1/06 84/622
2015/0269922 A1 * 9/2015 Matsunaga ..... G10H 7/04 84/605

* cited by examiner

FIG.5

500

| KEY NUMBER | PITCH | RESONANCE FLAG |
|---|---|---|
| 0 | | |
| 1 | | |
| 2 | | |
| ⋮ | ⋮ | ⋮ |
| 87 | | |

700

1000

| PITCH DIFFERENCE | OVERTONE | STRENGTH COEFFICIENT |
|---|---|---|
| 12 | 2nd OVERTONE | 1 |
| 19 | 3rd OVERTONE | 0.8 |
| 24 | 4th OVERTONE | 0.8 |
| 28 | 5th OVERTONE | 0.6 |
| 31 | 6th OVERTONE | 0.4 |
| 36 | 8th OVERTONE | 0.2 |

RESONANCE TONE GENERATING APPARATUS, METHOD OF GENERATING RESONANCE TONES, RECORDING MEDIUM AND ELECTRONIC INSTRUMENT

CROSS-REFERENCE TO RELATED APPLICATION

The present application is based upon and claims the benefit of priority from the prior Japanese Patent Application No. 2015-060154, filed Mar. 23, 2015, the entire contents of which are incorporated herein by reference.

BACKGROUND OF THE INVENTION

1. Field of the Invention

The present invention relates to a resonance tone generating apparatus, a method of generating resonance tones, a recording medium and an electronic musical instrument.

2. Description of the Related Art

In an electronic musical instrument, it is known that, when a player steps on a damper pedal and/or presses plural keys, strings having harmonic relation with each other generate resonance tones. For example, refer to the technology disclosed in Japanese Unexamined Patent Publication No. 2009-175677.

Also, an electronic musical instrument is known, the whole musical scale of which can be adjusted when a tuning-scale curve is applied for a stretched tuning.

In the conventional electronic instrument, when the tuning-scale curve is applied for a stretched tuning to change pitches, it is hard to control a resonance characteristics in consideration of the change of pitches. For example, it is hard in the conventional electronic instrument to reproduce an effect of the resonance characteristics in response to the change of pitches by tuning operation as in acoustic pianos.

SUMMARY OF THE INVENTION

The present invention can give a resonance tone generating apparatus an effect that changes the resonance characteristics, when pitches assigned to keys are changed.

According to one aspect of the invention, there is provided a resonance tone generating apparatus provided with plural performance operators, wherein the performance operators are assigned with different pitches respectively, which apparatus has a processing unit which performs a pitch changing process for changing the pitch assigned to one of the plural performance operators, a judging process for judging whether any one of the plural performance operators has been operated, an obtaining process for obtaining a non-operated performance operator from among the performance operators which are determined not operated in the judging process, the non-operated performance operator having a prescribed relation with the performance operator which is determined operated in the judging process, and a tone generation instructing process for giving an instruction of generating a resonance tone on the basis of a resonance strength and a resonance pitch assigned to the non-operated performance operator, and wherein in the tone generation instructing process, when the pitch of the operated performance operator is not changed in the pitch changing process, the resonance strength is determined based on the pitch assigned to the operated performance operator and the resonance pitch assigned to the non-operated performance operator, and meanwhile, when the pitch of the operated performance operator is changed to a changed pitch in the pitch changing process, the resonance strength is determined based on the changed pitch of the operated performance operator and the resonance pitch assigned to the non-operated performance operator.

BRIEF DESCRIPTION OF THE DRAWINGS

FIG. 5 is a view showing an example of a data configuration of data given in a resonance flag table.

DETAILED DESCRIPTION OF THE PREFERRED EMBODIMENTS

Figure 1:
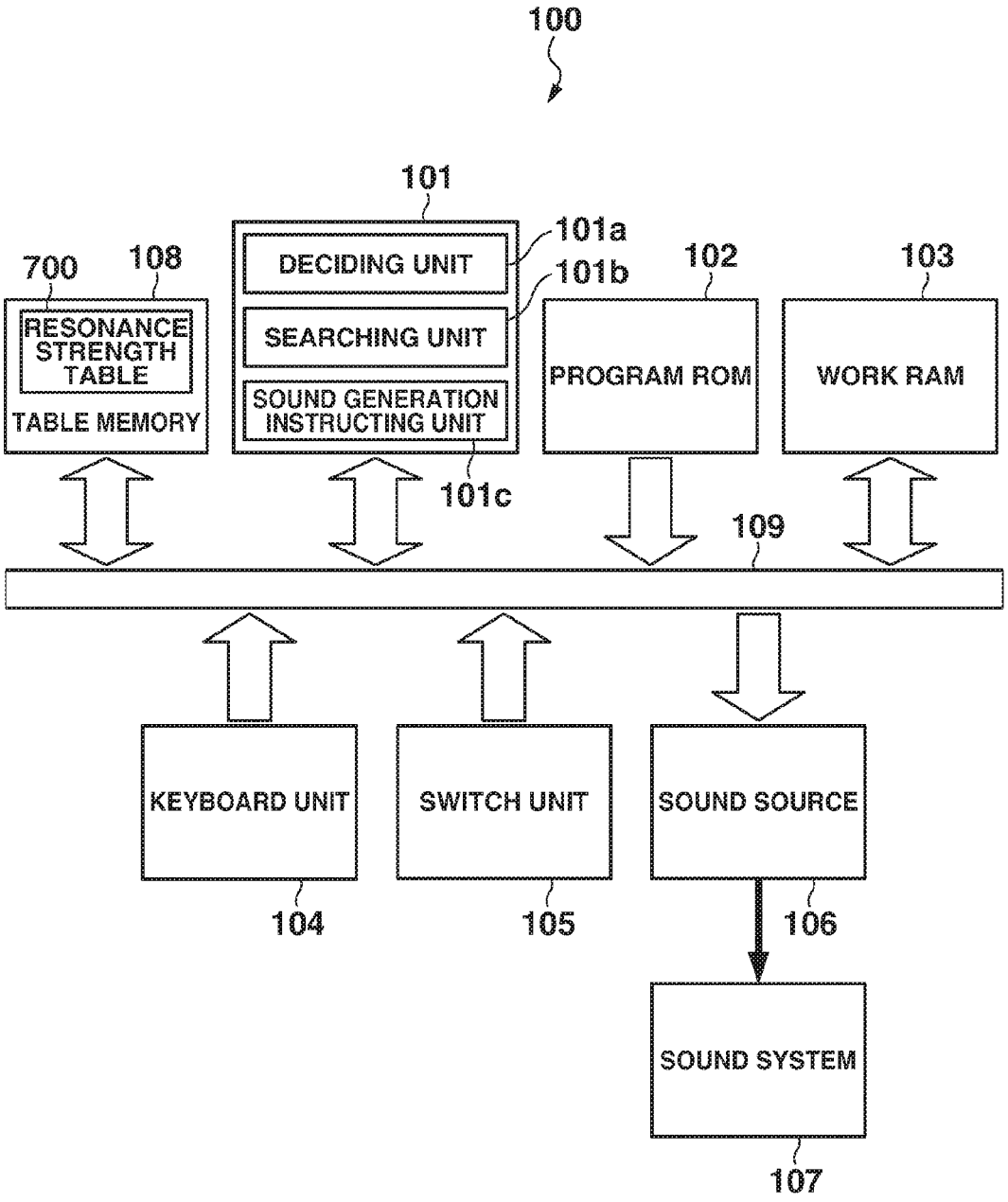
FIG. 1 is a block diagram showing an example of a hardware configuration of an electronic musical instrument according to the embodiments of the present invention.

In this invention, a resonance tone generated by an electronic musical instrument is a resonance tone which is generated when a player steps on a damper pedal and/or presses plural keys having harmonic relation with each other in an acoustic musical instrument. The electronic musical instrument according to the embodiments of the present invention will be described with reference to the accompanying drawings in detail. FIG. 1 is a block diagram showing an example of a hardware configuration of the electronic musical instrument according to the embodiments of the present invention. The electronic musical instrument 100 shown in FIG. 1 will be described, for instance, as an electronic piano in the following description. As shown in FIG. 1, the electronic musical instrument 100 comprises CPU (Central Processing Unit) 101, a program ROM (Read Only Memory) 102, a work RAM (Random Access Memory) 103, a keyboard unit 104, a switch unit 105, a sound source 106, and a table memory 108. These elements are connected to each other through a system bus 109. An output of the sound source 106 is supplied to a sound system 107.

CPU 101 uses the work RAM 103 as a work memory, and executes a control program stored in the program ROM 102 to control the whole operation of the electronic musical instrument 100 shown in FIG. 1.

The keyboard unit 104 is provided with a keyboard having plural keys, and serves to detects a key pressing operation and/or a key releasing operation performed on the plural keys of the keyboard and to gives notice CPU 101 of the detected key pressing operation and/or key releasing operation.

The switch unit 105 serves to detect various switch operations executed by the performer and to give notice CPU 101 of the detected switch operations. The switch unit 105 includes a damper pedal (not shown).

The sound source 106 generates digital musical-tone waveform data based on data of instructing a sound generation received from CPU 101, and supplies the generated waveform data to the sound system 107. The sound system 107 converts the digital musical-tone waveform data into an analog musical-tone waveform signal, and amplifies the converted analog signal to output the amplified analog signal through a built-in speaker.

Figures 9, 10:
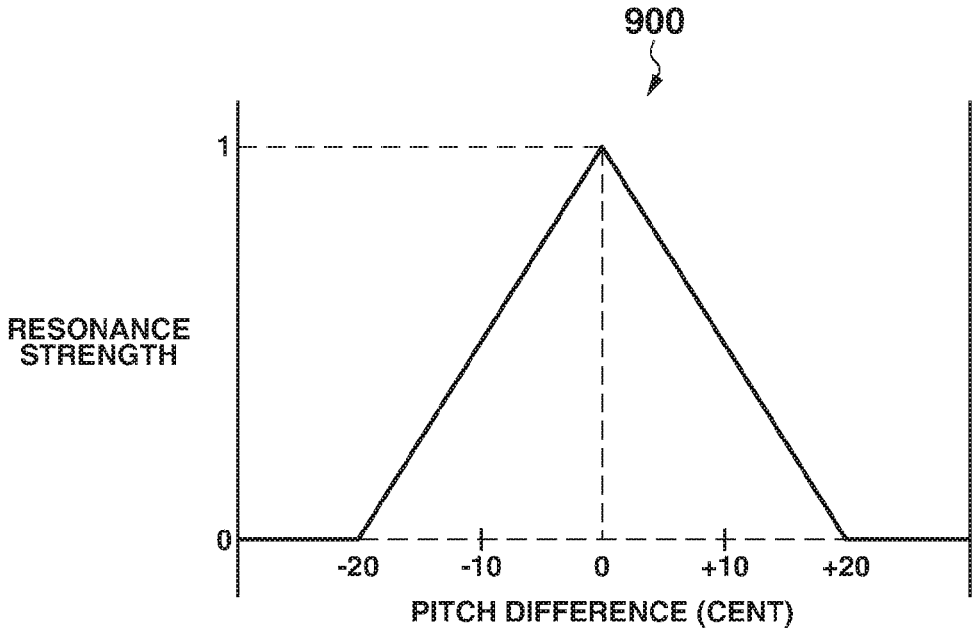
FIG. 9 is a view showing an example of a data configuration of data given in a resonance strength-first table.
FIG. 10 is a view showing an example of a data configuration of data given in a resonance strength-second table.

The table memory 108 stores table data such as a resonance flag table 500 (Refer to FIG. 5), a resonance strength table 700 (Refer to FIG. 7), a resonance strength-first table 900 (Refer to FIG. 9), and a resonance strength-second table 1000 (Refer to FIG. 10). These tables 500, 700, 900 and 1000 will be described later.

Figure 4:
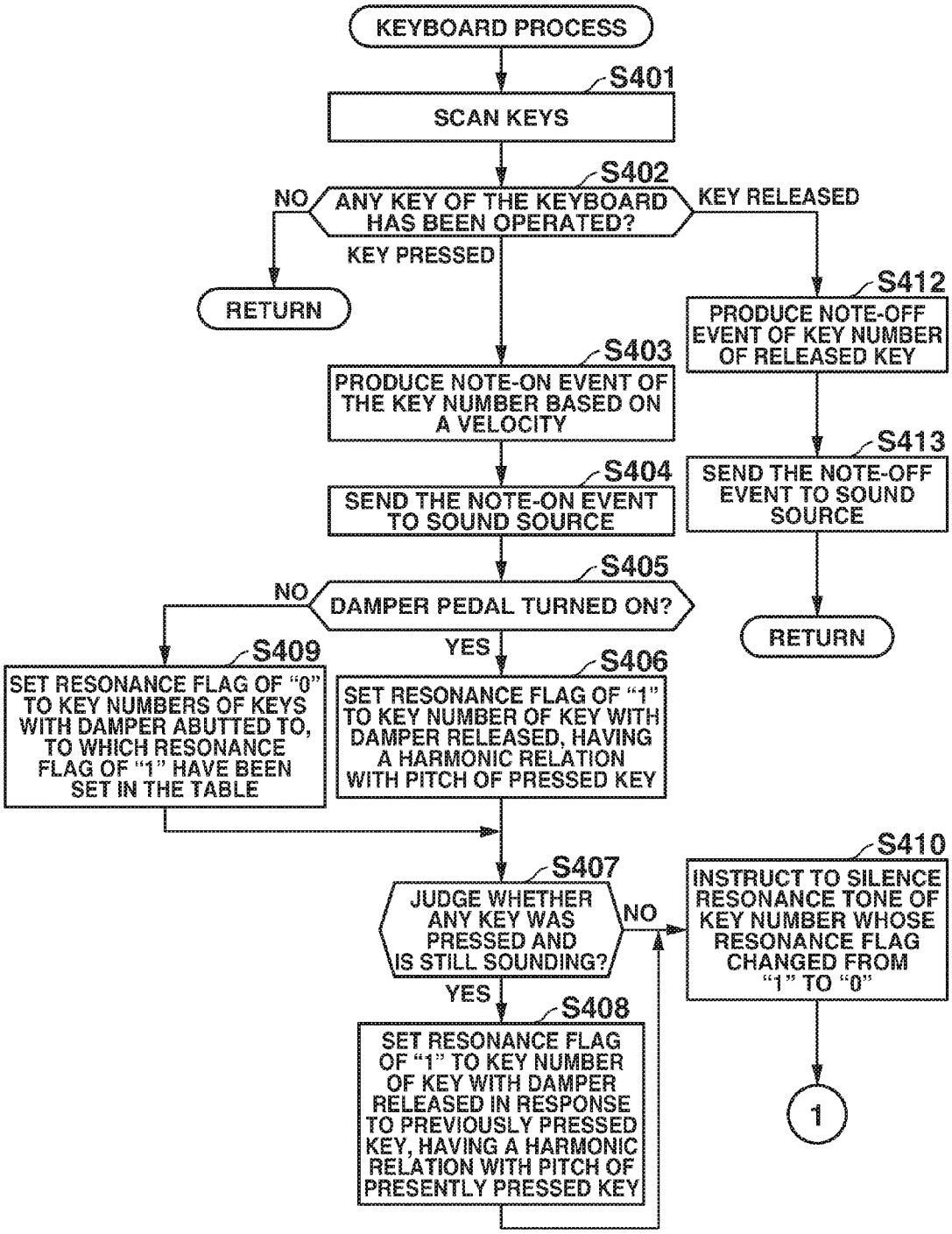
FIG. 4 is a flow chart showing the detail of a keyboard process in the flow chart of FIG. 2.
Figure 6:
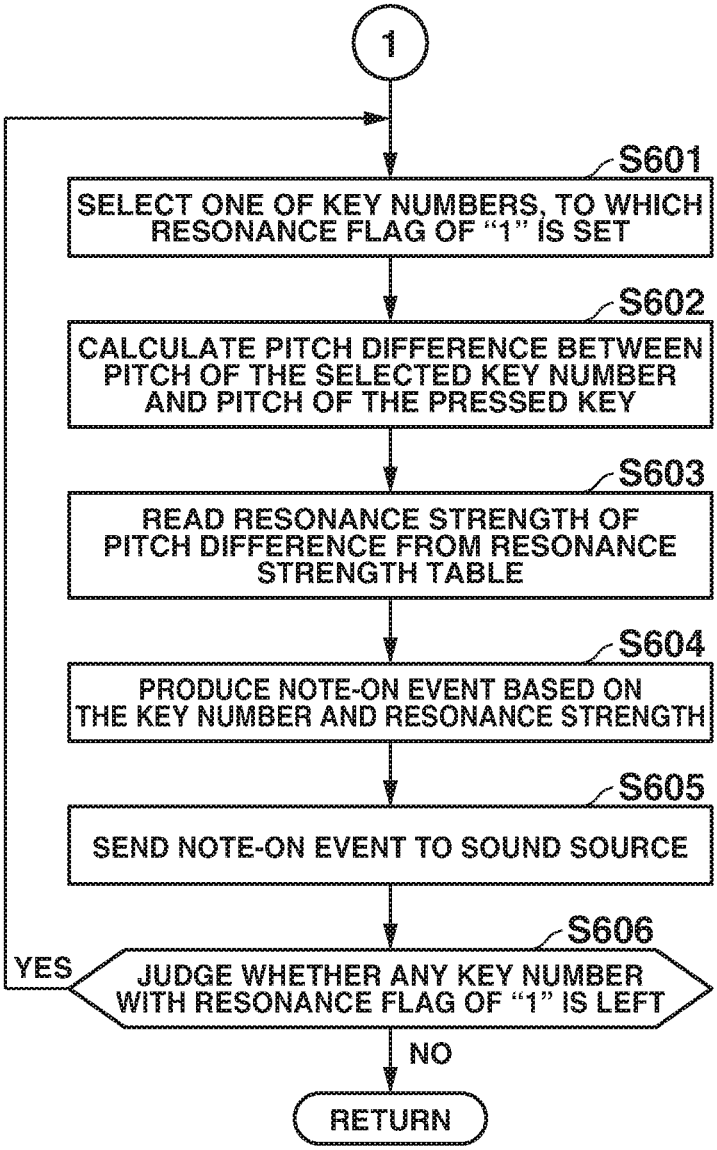
FIG. 6 is a flow chart of a first embodiment of a controlling process performed in the keyboard of FIG. 4.
Figure 8:
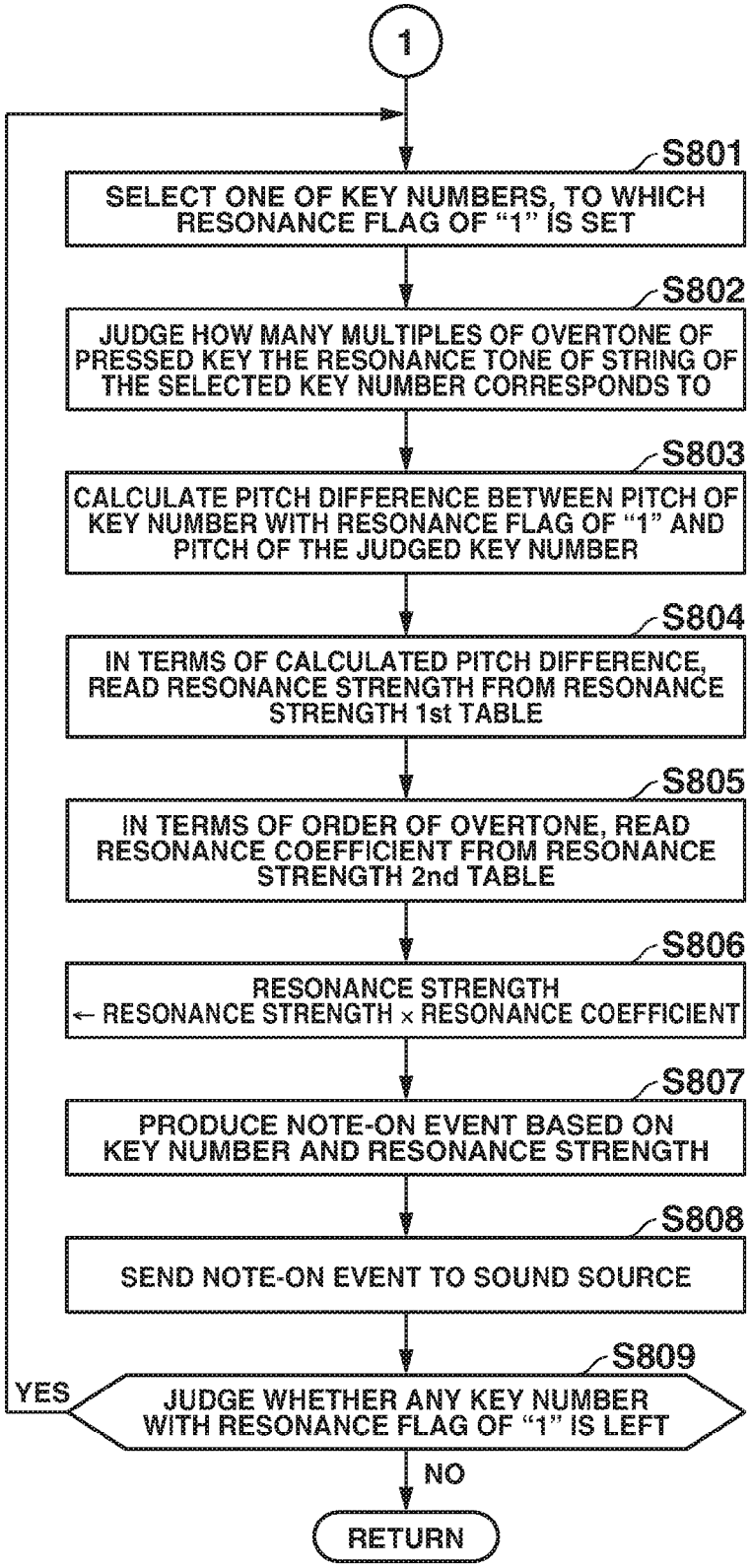
FIG. 8 is a flow chart of a second embodiment of the controlling process performed in the keyboard of FIG. 4.

The electronic musical instrument 100 according to the embodiments of the invention will be realized by CPU 101, when the control program is executed by CPU 101 to perform processes in accordance with flow charts shown in FIG. 4, FIG. 6, and FIG. 8. It is possible to store the control program in mobile recording medium (not shown) and to distribute the recording medium with the control program stored thereon or the control program can be obtained from the Internet through a communication interface and stored in the program ROM 102.

When any one of the plural keys (not shown) in the keyboard unit 104 has been operated, CPU 101 executes the control program to realize a function of a searching unit 101*a*, a function of a deciding unit 101*b*, and a function of a sound generation instructing unit 101*c*, wherein the searching unit 101*a* serves to search for a key having a prescribed relation with the operated key, the deciding unit 101*b* serves to decide a resonance strength based on a relation between a pitch assigned to the searched key and a pitch assigned to the operated key, and the sound generation instructing unit 101*c* serves to instruct to generate a resonance tone based on the decided resonance strength and the pitch assigned to the searched key.

Figure 2:
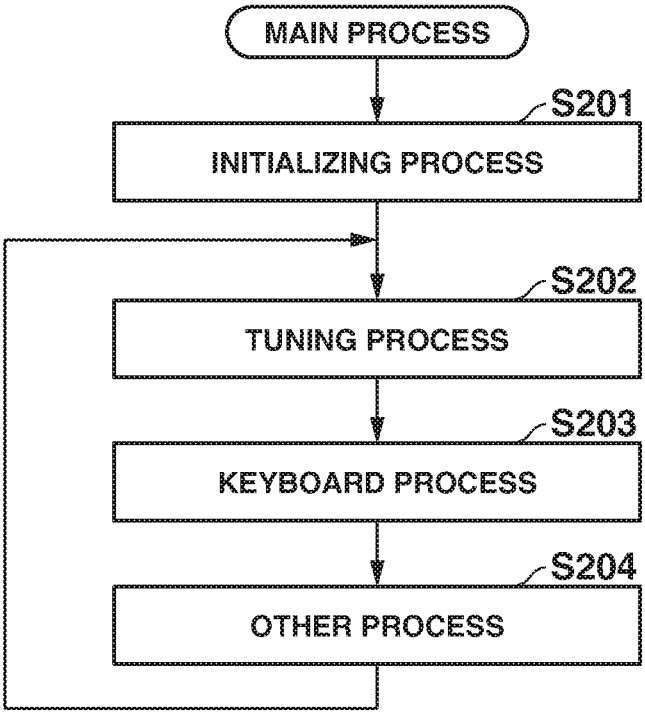
FIG. 2 is a flow chart of an example of a main process performed in the electronic musical instrument according to the embodiments of the present invention.

FIG. 2 is a flow chart of an example of a main process performed by CPU 101, when CPU 101 executes the control program stored in the program ROM 102. When a power switch (not shown) in the switch unit 105 (FIG. 1) is turned on, CPU 101 starts processing the main process in accordance with the flow chart of FIG. 2.

CPU 101 executes an initializing process, initializing variables in the work RAM 103 (step S201).

Then, CPU 101 repeatedly performs a tuning process (step S202), a keyboard process (step S203), and other process (step S204).

Figure 3:
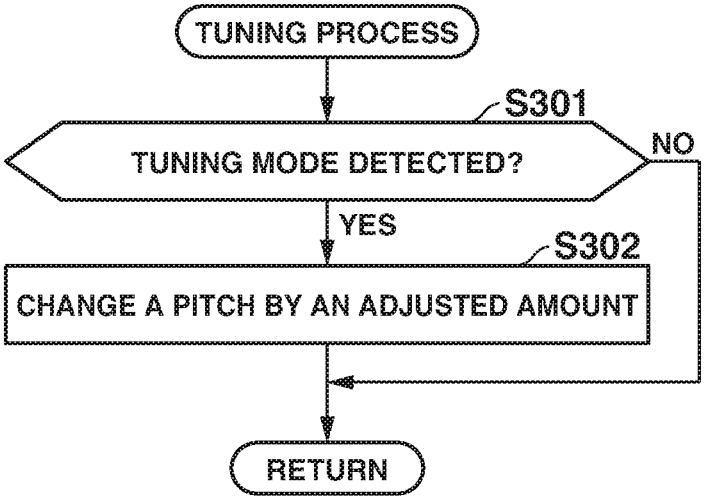
FIG. 3 is a flow chart showing the detail of a tuning process in the flow chart of FIG. 2.

FIG. 3 is a flow chart showing the detail of the tuning process at step S202 in FIG. 2.

When the performer operates a tuning-mode switch (not shown) in the switch unit 105, CPU 101 judges whether a tuning mode has been detected in other process at step S204 in FIG. 2 (step S301 in FIG. 3).

When it is determined that the tuning mode has been detected in other process at step S204 (YES at step S301), CPU 101 changes a pitch assigned the key number (note number) corresponding to a key designated on the keyboard 104 by the performer, that is, in case of an acoustic piano, a vibration frequency of a string stretched in connection with the pressed key is changed by an amount adjusted by the performer operating a pitch increasing/decreasing switch (not shown) in the switch unit 105 (step S302). Then, a relation between the key number and the pitch set in this way is memorized in the resonance flag table 500 (FIG. 1), and also is set in a memory (not shown) in the sound source 106. The key numbers assigned respectively to the keys are the same as the string numbers indicating the strings of the acoustic piano.

The sound source 106 is composed so as to receive from CPU 101 a note-on event indicating a prescribed key number and to read a pitch corresponding to the indicated prescribed key number from the built-in memory, thereby generating a musical-tone waveform based on said pitch. The initial relation between the key number and pitch is transferred, for example, from the program ROM 102 to the resonance flag table 500 in the table memory 108 and the memory of the sound source 106 in the initializing process at step S201 in FIG. 2. It is possible for the sound source 106 to directly refer to the resonance flag table 500 in the table memory 108 in stead of referring to the built-in memory, thereby obtaining the corresponding pitch. Finishing changing the pitch at step S302 (FIG. 3), CPU 101 finishes the tuning process at step S202 in FIG. 2.

FIG. 4 is a flow chart showing the detail of the keyboard process at step S203 in FIG. 2.

CPU 101 scans the keys of the keyboard 104 of FIG. 1 (step S401 in FIG. 4).

CPU 101 judges whether any key of the plural keys of the keyboard 104 has been operated (step S402).

When it is determined that no key of the plural keys of the keyboard 104 has been operated (NO at step S402), then CPU 101 finishes the keyboard process shown in FIG. 4 (also shown at step S203 in FIG. 2).

When it is determined that one of the plural keys of the keyboard 104 has been released (KEY RELEASED step S402), then CPU 101 advances to step S412 and produces a note-off event of the key number of the released key (step S412). CPU 101 further advances to step S413 and sends the produced note-off event to the sound source 106 of FIG. 1 (step S413). Upon receipt of the note-off event, the sound source 106 performs a silencing process on a musical tone of the key number designated by the note-off event, which tone has been sounding. Thereafter, CPU 101 finishes the keyboard process shown in FIG. 4 (also shown at step S203 in FIG. 2).

When it is determined that one of the plural keys of the keyboard 104 has been pressed (KEY PRESSED step S402), then CPU 101 advances to step S403 and produces a note-on event of the key number of the pressed key based on a velocity (step S403). CPU 101 further advances to step S404 and sends the note-on event to the sound source 106 of FIG. 1 (step S404). As described in the process at step S302, then the sound source 106 reads the pitch corresponding to the key number designated by the note-on event from the built-in memory and produces a musical-tone waveform data based on the pitch and the velocity designated by the note-on event.

CPU 101 judges whether the damper pedal in the switch unit 105 (FIG. 1) has been turned on by the performer (step S405).

In the acoustic piano, a damper mechanism is composed such that when the damper pedal is turned on, the damper will be released from all the strings, and that when a key is pressed and a string is struck, the strings having a harmonic relation with the struck string will vibrate by resonance, also.

To obtain a resonance effect similar to the acoustic piano in the electronic piano according to the embodiments of the invention, when it is determined that the damper pedal has been turned on (YES at step S405), CPU 101 sets the resonance flag (of "1") to the key number of a key corresponding to the string which vibrates at a pitch having a harmonic relation with the pitch assigned to the pressed key (step S406). Depending only on relation between the key number of the key which has been pressed at present and the key number of the key, from whose string the damper is released, CPU 101 determines the above harmonic relation.

FIG. 5 is a view showing an example of a data configuration given in the resonance flag table 500 stored in the table memory 108 shown in FIG. 1. In the resonance flag table 500 shown in FIG. 5, areas for memorizing the pitches (the unit is "cent") and the resonance flags ("0" or "1") are assigned respectively to the key numbers "0" to "87". The pitches assigned to the key numbers are set in the initializing process at step S201 or in the tuning process at step S202 in FIG. 2. The resonance flag of "1" is set to the key number in the process at step S406. A note-on event is produced on the key number, to which the resonance flag of "1" has been set, as a similar manner to the key number of the key pressed at present, and the produced note-on event is supplied to the sound source 106, and outputted from there as a resonance tone.

CPU 101 judges whether any key (key number) was pressed and then is still sounding (step S407).

In the acoustic piano, when a key was pressed previously, the damper was released from some strings. Then, when another key is pressed at present, strings among the strings with the damper released previously, having a harmonic relation with the string of the another key pressed at present will resonate to generate resonance tones.

When it is determined that a key (key number) was pressed previously (YES at step S407), CPU 101 sets the resonance flag (of "1") to the key number of the key having string in a harmonic relation with the string of the key pressed at present, among the key numbers of keys whose strings from which the damper was released when a key was pressed previously, in a similar manner to step S406 (step S408).

Meanwhile, when it is determined that the damper pedal has been turned off (NO at step S405), CPU 101 sets the resonance flag of "0" to the key numbers of the keys among the keys with the damper abutted, to which key numbers the resonance flag of "1" has been previously set in the resonance flag table 500 in the table memory 108 shown in FIG. 1 (step S409).

Then, CPU 101 advances to step S407, and judges whether any key was pressed previously. When it is determined that a key was pressed previously (YES at step S407), CPU 101 sets the resonance flag of "1" to the key number of a key whose string which has a harmonic relation with the string of a key pressed at present, among the key numbers of keys, from whose strings the damper was released when the key was pressed previously (step S408).

CPU 101 gives an instruction of silencing the resonance tone of the key number whose resonance flag has been changed from "1" to "0" in the resonance flag table 500 at step S409 (step S410). In other words, CPU 101 produces a note-off event of the key number and sends the note-off event to the sound source 106 (FIG. 1) at step S410.

Receiving the note-off event, the sound source 106 performs the silencing process on the resonance tone generated from the key number of the key designated by the note-off event, when the damper pedal is turned off and the damper is brought to abut on said designated key.

The processes (at step S405 to step S410) among the series of processes along the flow chart of FIG. 4 realize the function of the searching unit 101*a*.

FIG. 6 is a flow chart of a first embodiment of a controlling process, which is performed after the process at step S410 in FIG. 4.

CPU 101 selects one of the key numbers, to which the resonance flag of "1" has been set in the resonance flag table 500 stored in the table memory 108 of FIG. 1 (step S601 in FIG. 6).

CPU 101 refers to the pitches and the resonance flags given in the resonance flag table 500 to calculate a difference (first pitch difference) between the pitch assigned to the key number selected from the resonance flag table 500 and the pitch of the key number of a currently pressed key (step S602).

In terms of the pitch difference (first pitch difference) calculated at step S602, CPU 101 refers to the resonance strength table 700 in the table memory 108 to obtain a resonance strength (first resonance strength) of the pitch difference (step S603).

Figure 7:
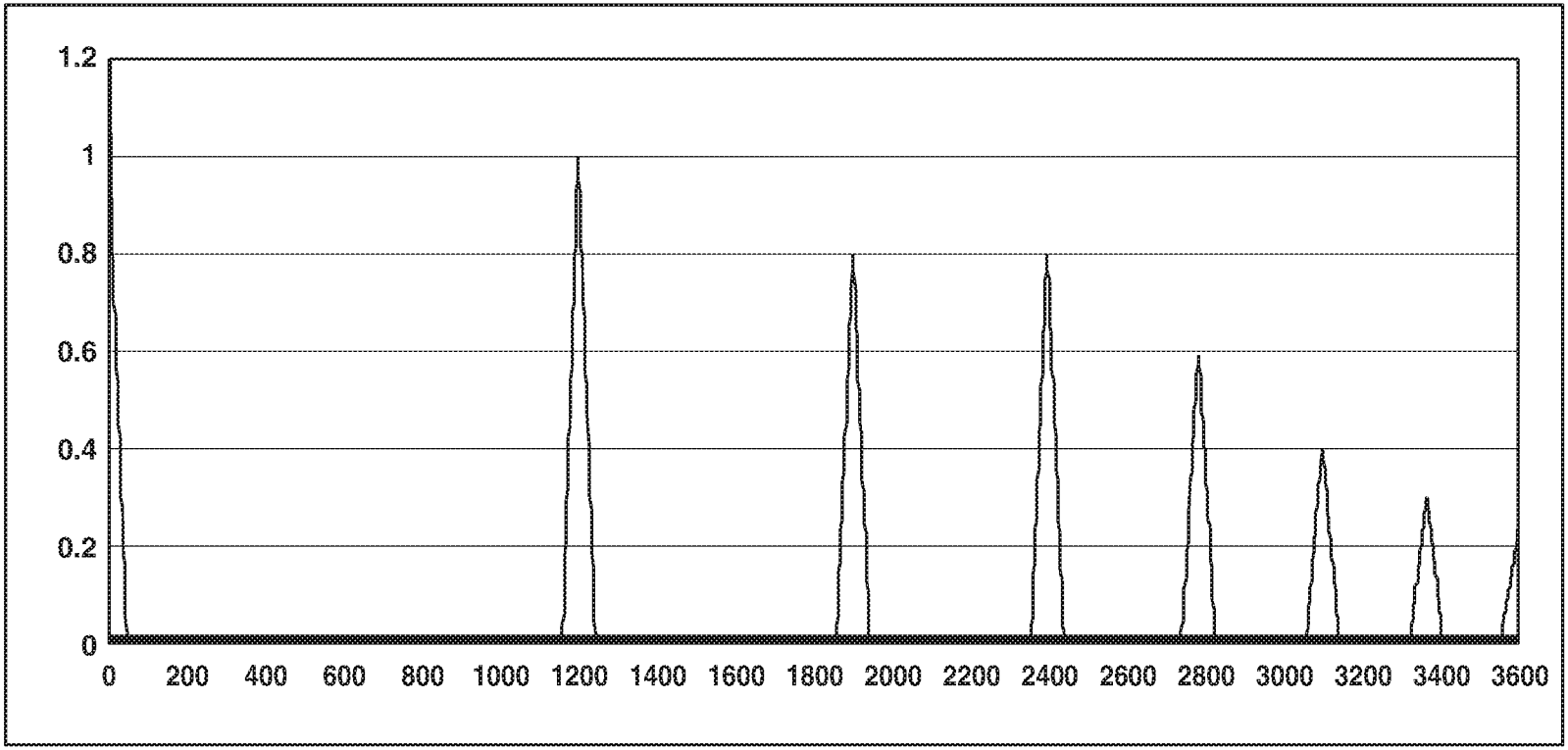
FIG. 7 is a view showing an example of data configuration of data given in a resonance strength table.

FIG. 7 is a view showing an example of data characteristics of data given in the resonance strength table 700. The resonance strength table 700 stores resonance strengths (first resonance strengths) at relative pitch differences between the pitch of the pressed key number (a note number for instructing a sound generation) and given pitches. In the data characteristics, the horizontal axis represents a pitch difference and the vertical axis represents the resonance strength. At the pitch differences having the harmonic relation with the pitch difference (=0) (corresponding to the pressed key tone), local peaks of resonance strength appear. As a pitch moves out of the pitch differences having the harmonic relation with the pitch difference (=0), the resonance strength will decrease sharply. Therefore, an effect may be applied to the electronic piano according to the embodiment of the invention, that the resonance tone will increase at a pitch difference having the precise harmonic relation with the tone of the currently pressed key and the resonance tone will decrease sharply at a pitch out of the pitch difference having the precise harmonic relation with the tone of the currently pressed key.

The processes (at step S601 to step S603) among the series of processes along the flow chart of FIG. 6 realize the function of the deciding unit 101*b*.

CPU 101 produces a note-on event of the resonance tone based on the key number of the resonance tone selected at step S601 and the resonance strength of the key number determined at step S603 (step S604), and sends the produced note-on event to the sound source 106 of FIG. 1 (step S605). Then, the sound source 106 reads from the built-in memory the pitch corresponding to the key number designated in the received note-on event, and generates musical-tone waveform data based on the pitch and the resonance strength (velocity) designated in the note-on event.

The processes (at step S604 to step S605) among the series of processes along the flow chart of FIG. 6 realize the function of the sound generation instructing unit 101*c*.

Thereafter, CPU 101 judges whether any other key number with the resonance flag of "1" set is left in the resonance flag table 500 in the table memory 108 (step S606).

When it is determined that the key number with the resonance flag of "1" set is still left in the resonance flag table 500 (YES at step S606), CPU 101 returns to step S601, and repeatedly performs the processes (at step S601 to step S606) on the key number left in the resonance flag table 500.

Meanwhile, when it is determined that no key number with the resonance flag of "1" set is left in the resonance flag table 500 (NO at step S606), CPU 101 finishes the process shown in FIG. 4 and FIG. 6, finishing the keyboard process at step S203 shown in FIG. 2.

FIG. 8 is a flow chart of a second embodiment of the controlling process, which is performed after the process at step S407 or step S408 in FIG. 4.

CPU 101 selects one of the key numbers, to which the resonance flag of "1" is set, in the resonance flag table 500 stored in the table memory 108 of FIG. 1 (step S801 in FIG. 8).

CPU 101 judges how many multiples of the harmonic overtone of the currently pressed key the resonance tone of the string of the key number selected at step S801 corresponds to (step S802). CPU 101 determines the harmonic relation depending only on the relationship between the key number of the currently pressed key and the key number selected at step S801.

CPU 101 refers to the pitches and the resonance flags given in the resonance flag table 500 to calculate a difference (second pitch difference) between the pitch assigned to the key number, to which the resonance flag of "1" is assigned, and the pitch of the key number of the harmonic overtone judged at step S802 (step S803).

In terms of the pitch difference (second pitch difference) calculated at step S803, CPU 101 refers to the resonance strength-first table 900 in the table memory 108 to obtain a resonance strength (second resonance strength) of the pitch difference (step S804).

FIG. 9 is a view showing an example of a data configuration of the resonance strength-first table 900. The resonance strength-first table 900 stores resonance strengths (second resonance strengths) at all the relative pitch differences between a center frequency and given pitches in the positive and negative directions, wherein the center frequency is set at a key number (a note number of generating a harmonic overtone) having a harmonic relation with a pressed key number (a note number of instructing a tone generation).

In the first embodiment of the controlling process, the resonance strength table 700 shown in FIG. 7 stores the resonance strengths (first resonance strengths) at all the relative pitch differences between the pitch of the pressed key number (a note number of instructing a tone generation) and given keys over the keyboard 104 of FIG. 1. On the contrary, in the second embodiment of the controlling process, the resonance strength-first table 900 shown in FIG. 9 stores only the resonance strengths (second resonance strengths) at relative pitch differences from one harmonic overtone in the resonance strength table 700, and therefore a memory capacity of the table memory 108 can be saved.

In terms of the order of the harmonic overtone judged at step S802, CPU 101 refers to the resonance strength-second table 1000 in the table memory 108 to obtain a strength coefficient (third resonance strengths) corresponding to the order of overtone (step S805).

FIG. 10 is a view showing an example of a data configuration of data given in the resonance strength-second table 1000. The resonance strength-second table 1000 stores strength coefficients (third resonance strengths) for every order of the harmonic overtone (for instance, from 2nd overtone to 8th overtone) of the currently pressed key (the note number of generating the harmonic overtone). These strength coefficients correspond respectively to the peak values at positions of all the harmonic overtones in the resonance strength table 700 shown in FIG. 7 in the first embodiment of the controlling process. In this way, the data stored in the resonance strength table 700 in the first embodiment of is separated and stored in the resonance strength-first table 900 of FIG. 9 and the resonance strength-second table 1000 in the second embodiment, and therefore it is possible to substantially reduce a memory capacity of the table memory 108 for storing the resonance strengths of each pitch difference.

CPU 101 multiplies the resonance strength (second resonance strength) obtained at step S804 by the strength coefficient (third resonance strength) obtained at step S805 to calculate a resonance strength of the resonance tone selected at present (step S806).

The processes (at step S801 to step S806) among the series of processes along the flow chart of FIG. 8 realize the function of the deciding unit 101*b*.

CPU 101 produces a note-on event of the resonance tone based on the key number of the resonance tone selected at step S801 and the resonance strength of the key number determined at step S806 (step S807), and sends the produced note-on event to the sound source 106 of FIG. 1 (step S808). Then, the sound source 106 reads from the built-in memory the pitch corresponding to the key number designated in the note-on event, and generates musical-tone waveform data based on the pitch and the resonance strength (velocity) designated in the note-on event.

The processes (at step S807 to step S808) among the series of processes along the flow chart of FIG. 8 realize the function of the sound generation instructing unit 101*c*.

Thereafter, CPU 101 judges whether any other key number with the resonance flag of "1" set is left in the resonance flag table 500 in the table memory 108 (step S809).

When it is determined that the key number with the resonance flag of "1" set is still left in the resonance flag table 500 (YES at step S809), CPU 101 returns to step S801, and repeatedly performs the processes (at step S801 to step S809) on the key number left in the resonance flag table 500.

Meanwhile, when it is determined that no key number with the resonance flag of "1" set is left in the resonance flag table 500 (NO at step S606), CPU 101 finishes the process shown in FIG. 4 and FIG. 8, finishing the keyboard process at step S203 shown in FIG. 2.

Figure 11:
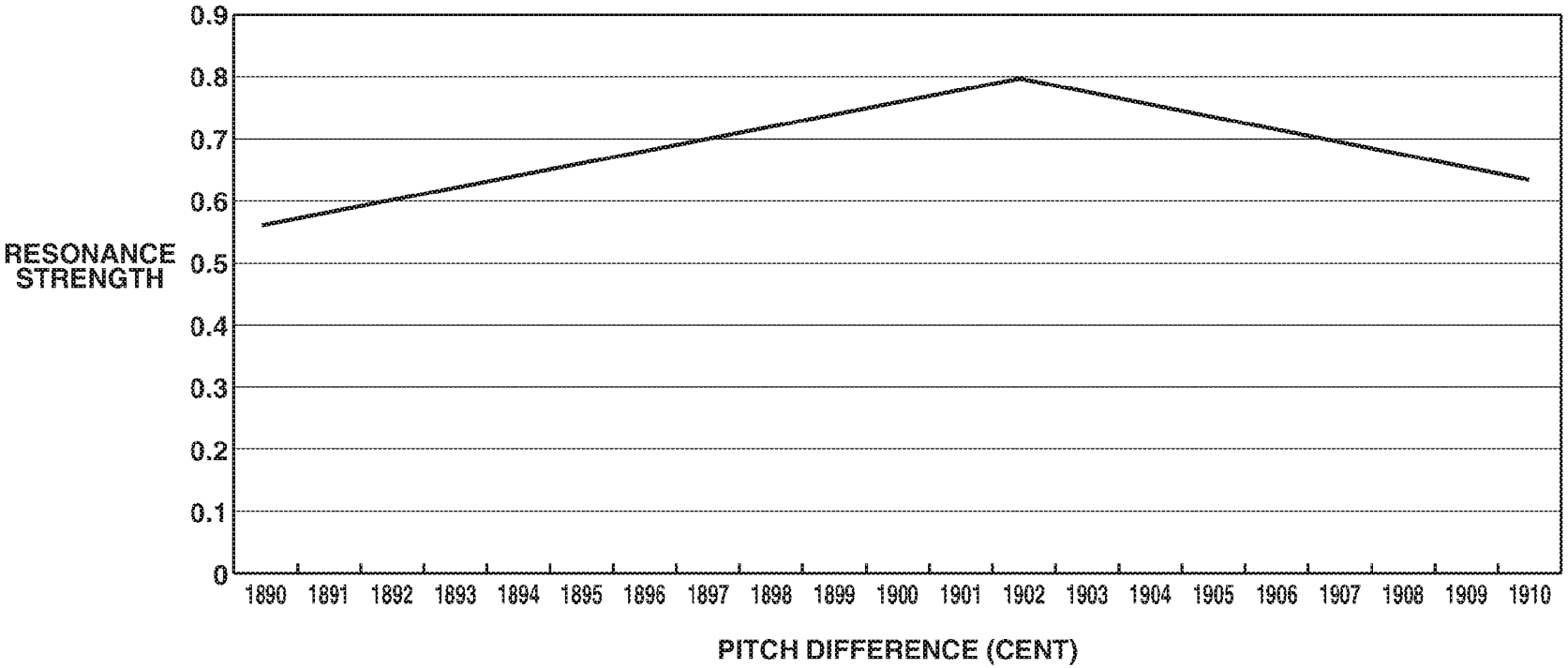
FIG. 11 is a view showing an example of data characteristics of resonance strength.

FIG. 11 is a view showing an example of data characteristics of the resonance strength of the 3rd harmonic overtone calculated in the first embodiment of the controlling process (FIG. 6) or in the second embodiment of the controlling process (FIG. 8). When the string of the key corresponding to the 3rd harmonic overtone has a pitch different, for example, by 1902 cents from the string of the pressed key, the resonance strength of the 3rd harmonic overtone will be the maximum of 0.8, as shown in FIG. 11, and it will be understood that when the pitch of the key is changed during the tuning process at step S202 (FIG. 2) and as the pitch difference is apart from the 1902 cents toward the positive and/or negative direction along the horizontal axis in FIG. 11, the resonance strength will decrease.

When the resonance strength table is prepared for each harmonic overtone and/or for all the pitch differences, and when the generation of resonance tones is controlled with reference to the resonance strength tables in the controlling process, a pitch adjustment for each key, and changing a tuning curve (so-called a stretched tuning curve) of all the keys will make variation in a tone-generating characteristics of resonance tones and tone color. Using the electronic musical instrument according to the embodiments of the present invention, the user can enjoy resonance effects, including pitches and tone quality, similar to the acoustic piano in the electronic piano, by adjusting the pitch difference between the string of the pressed key and the string of the resonance tone to change the resonance strength.

In the forgoing description, the present invention has been described taking the electronic piano as an example, but the present invention can be applied to a wide variety of electronic instruments including electronic stringed instruments.

Although specific embodiments of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

What is claimed is:

1. A resonance tone generating apparatus provided with plural performance operators, wherein the plural performance operators are previously assigned with different pitches respectively, the apparatus comprising:

a processing unit which performs a pitch changing process for changing the pitch assigned to one of the plural performance operators;

a judging process for judging whether any one of the plural performance operators has been operated;

an obtaining process for obtaining a non-operated performance operator from among the performance operators which are determined not operated in the judging process, the non-operated performance operator having a prescribed relation with the performance operator which is determined operated in the judging process; and a tone generation instructing process for giving an instruction of generating a resonance tone on the basis of a resonance strength and a resonance pitch assigned to the non-operated performance operator, and wherein in the tone generation instructing process, when the pitch of the operated performance operator is not changed in the pitch changing process, the resonance strength is determined based on the pitch assigned to the operated performance operator and the resonance pitch assigned to the non-operated performance operator, and meanwhile, when the pitch of the operated performance operator is changed to a changed pitch in the pitch changing process, the resonance strength is determined based on the changed pitch of the operated performance operator and the resonance pitch assigned to the non-operated performance operator.

2. The resonance tone generating apparatus according to claim 1, wherein the processing unit determines in the tone generation instructing process the resonance strength based on a relation between the resonance pitch assigned to the non-operated performance operator and the pitch assigned to the operated performance operator.

3. The resonance tone generating apparatus according to claim 2, wherein the processing unit determines in the tone generation instructing process the resonance strength based on a difference between the resonance pitch assigned to the non-operated performance operator and the pitch assigned to the operated performance operator.

4. The resonance tone generating apparatus according to claim 3, further comprising:

a resonance strength table which contains data representing a relation between the resonance strength and a pitch difference, wherein the pitch difference represents the difference between the resonance pitch assigned to the non-operated performance operator and the pitch assigned to the operated performance operator.

5. The resonance tone generating apparatus according to claim 2, wherein the processing unit searches in the searching process for the non-operated performance operator assigned with a pitch having a harmonic relation with the pitch assigned to the operated performance operator through the plural performance operators.

6. The resonance tone generating apparatus according to claim 5, wherein in the tone generation instructing process the processing unit judges the harmonic relation between the non-operated performance operator and the operated performance operator, detects a difference between the resonance pitch assigned to the non-operated performance operator and the operated pitch assigned to the operated performance operator, and determines the resonance strength based on the judged harmonic relation and the detected difference.

7. A method of generating a resonance tone, used in a resonance tone generating apparatus, wherein the resonance tone generating apparatus is provided with plural performance operators which are assigned with different pitches respectively, the method comprising:

a pitch changing step of changing the pitch assigned to one of the plural performance operators;

a judging step of judging whether anyone of the plural performance operators has been operated;

an obtaining step of obtaining a non-operated performance operator from among the performance operators which are determined not operated in the judging step, the non-operated performance operator having a prescribed relation with the performance operator which is determined operated in the judging step; and a tone generation instructing step of giving an instruction of generating a resonance tone on the basis of a resonance strength and a resonance pitch assigned to the non-operated performance operator, wherein in the tone generation instructing step, when the pitch of the operated performance operator is not changed in the pitch changing step, the resonance strength is determined based on the pitch assigned to the operated performance operator and the resonance pitch assigned to the non-operated performance operator, and meanwhile, when the pitch of the operated performance operator is changed to a changed pitch in the pitch changing step, the resonance strength is determined based on the changed pitch of the operated performance operator and the resonance pitch assigned to the non-operated performance operator.

8. The method of generating a resonance tone according to claim 7, wherein in the tone generation instructing step the resonance strength is determined based on a relation between the resonance pitch assigned to the non-operated performance operator and the pitch assigned to the operated performance operator.

9. The method of generating a resonance tone according to claim 8, wherein in the tone generation instructing step the resonance strength is determined based on a difference between the resonance pitch assigned to non-operated performance operator and the pitch assigned to the operated performance operator.

10. The method of generating a resonance tone according to claim 8, wherein in the obtaining step, the non-operated performance operator assigned with the resonance pitch having a harmonic relation with the pitch assigned to the operated performance operator is obtained among the plural performance operators.

11. The method of generating a resonance tone according to claim 10, wherein in the tone generation instructing step, a harmonic relation between the non-operated performance operator and the operated performance operator is judged, and a difference is detected between the resonance pitch assigned to non-operated performance operator and the pitch assigned to the operated performance operator, and then the resonance strength is determined based on the judged harmonic relation and the detected difference.

12. A non-transitory computer-readable recording medium with an executable program stored thereon, the program, when installed on a computer, instructing the computer to execute the following steps, the computer being mounted on mounted on a resonance tone generating apparatus, and the resonance tone generating apparatus provided with plural performance operators which are assigned with different pitches respectively, the steps comprising:

a pitch changing step of changing the pitch assigned to one of the plural performance operators;

a judging step of judging whether anyone of the plural performance operators has been operated;

an obtaining step of obtaining a non-operated performance operator from among the performance operators which are determined not operated in the judging step, the non-operated performance operator having a prescribed relation with the performance operator which is determined operated in the judging step; and a tone generation instructing step of giving an instruction of generating a resonance tone on the basis of a resonance strength and a resonance pitch assigned to the non-operated performance operator, wherein in the tone generation instructing step, when the pitch of the operated performance operator is not changed in the pitch changing step, the resonance strength is determined based on the pitch assigned to the operated performance operator and the resonance pitch assigned to the non-operated performance operator, and meanwhile, when the pitch of the operated performance operator is changed to a changed pitch in the pitch changing step, the resonance strength is determined based on the changed pitch of the operated performance operator and the resonance pitch assigned to the non-operated performance operator.

13. The non-transitory computer-readable recording medium according to claim 12, wherein in the tone generation instructing step the resonance strength is determined based on a relation between the resonance pitch assigned to the non-operated performance operator and the pitch assigned to the operated performance operator.

14. The non-transitory computer-readable recording medium according to claim 13, wherein in the tone generation instructing step the resonance strength is determined based on a difference between the resonance pitch assigned to the non-operated performance operator and the pitch assigned to the operated performance operator.

15. The non-transitory computer-readable recording medium according to claim 13, wherein the searching step, the non-operated performance operator assigned with the resonance pitch having a harmonic relation with the pitch assigned to the operated performance operator is searched for through the plural performance operators.

16. The non-transitory computer-readable recording medium according to claim 15, wherein the tone generation instructing step, a harmonic relation between the non-operated performance operator and the operated performance operator is judged, and a difference is detected between the resonance pitch assigned to non-operated performance operator and the pitch assigned to the operated performance operator, and then the resonance strength is determined based on the judged harmonic relation and the detected difference.

17. An electronic musical instrument comprising:

the resonance tone generating apparatus as defined in claim 1; and a sound source which generates a musical tone based on the pitch assigned to the operated performance operator, and generates a resonance tone based on an instruction of generating a resonance tone, sent from the resonance tone generating apparatus.

18. The electronic musical instrument according to claim 17, wherein the plural performance operators provided on the resonance tone generating apparatus have plural keys respectively.

* * * * *